US009454900B2

(12) United States Patent
Obata

(10) Patent No.: US 9,454,900 B2
(45) Date of Patent: Sep. 27, 2016

(54) RADIO WAVE RECEIVER

(71) Applicant: KABUSHIKI KAISHA TOKAI RIKA DENKI SEISAKUSHO, Aichi (JP)

(72) Inventor: Katsufumi Obata, Aichi (JP)

(73) Assignee: KABUSHIKI KAISHA TOKAI RIKA DENKI SEISAKUSHO, Aichi (JP)

( * ) Notice: Subject to any disclaimer, the term of this patent is extended or adjusted under 35 U.S.C. 154(b) by 267 days.

(21) Appl. No.: 14/494,610

(22) Filed: Sep. 24, 2014

(65) Prior Publication Data

US 2015/0097656 A1 Apr. 9, 2015

(30) Foreign Application Priority Data

Oct. 7, 2013 (JP) ..... 2013-210305

(51) Int. Cl.
*G08C 17/02* (2006.01)

(52) U.S. Cl.
CPC ..... *G08C 17/02* (2013.01); *G08C 2201/12* (2013.01)

(58) Field of Classification Search
CPC ..... G08C 17/02; G08C 2201/12
USPC ..... 340/5.7, 5.71, 5.72
See application file for complete search history.

(56) References Cited

U.S. PATENT DOCUMENTS 4,701,923 A * 10/1987 Fukasawa ..... H03M 13/03 714/708
5,699,364 A * 12/1997 Sato ..... H04L 1/0007 714/41
6,236,850 B1 * 5/2001 Desai ..... G08C 17/02 340/10.1
2010/0226465 A1 * 9/2010 Nakayama ..... H04B 7/0871 375/347

FOREIGN PATENT DOCUMENTS

JP 2008-127893 A 6/2008

* cited by examiner

*Primary Examiner* — Nabil Syed

(57) ABSTRACT

A radio wave receiver includes a receiver controller that performs a signal capturing action in regular or irregular intervals to capture data transmitted on radio waves from a remote terminal in synchronization with the signal capturing action. The receiver controller includes a correctness determination unit and a capturing frequency setting unit. The correctness determination unit calculates an error rate or a correctness rate of the data captured by the receiver controller to determine the correctness of the captured data. The capturing frequency setting unit sets a capturing frequency indicating the number of times the signal capturing action is performed during a certain period in accordance with the correctness of the captured data.

11 Claims, 4 Drawing Sheets

| Bit Error Rate Kx | Operation |
|---|---|
| Ks<Kx | - |
| 0<Kx≦Ks | Increase Capturing Frequency |

RADIO WAVE RECEIVER

CROSS-REFERENCE TO RELATED APPLICATIONS

This application is based upon and claims the benefit of priority from prior Japanese Patent Application No. 2013-210305, filed on Oct. 7, 2013, the entire contents of which are incorporated herein by reference.

FIELD

This disclosure relates to a radio wave receiver capable of receiving radio waves transmitted from a remote terminal.

BACKGROUND

A wireless communication system includes a radio wave receiver that receives radio waves transmitted from a remote terminal to control various operations (refer to Japanese Laid-Open Patent Publication No. 2008-127893). The radio wave receiver intermittently captures signal frames from the received radio wave to reduce power consumption. The remote terminal transmits frames that include the same data during a single radio wave transmission period. The number of times the radio wave receiver performs a signal capturing action during a single radio wave transmission period is referred to as capturing frequency. Under a normal situation, the capturing frequency is set so that one or two frames can be captured during the radio wave transmission period. When receiving a radio wave transmitted from the remote controller, the radio wave receiver performs a signal capturing action and captures a frame from the received radio wave in synchronization with the signal capturing action.

SUMMARY

An increase in the capturing frequency would increase the opportunities during which the radio wave receiver may capture frames. This would increase the capturing success rate. Further, frames transmitted from the remote terminal would more likely be captured at an earlier stage. This would increase the average response speed. However, a higher capturing frequency would increase the power consumption of the radio wave receiver. It is thus desirable that the capturing success rate be improved while reducing power consumption.

One aspect of this disclosure is a radio wave receiver including a receiver controller that performs a signal capturing action in regular or irregular intervals to capture data transmitted on a radio wave from a remote terminal in synchronization with the signal capturing action. The receiver controller includes a correctness determination unit that calculates an error rate or a correctness rate of the data captured by the receiver controller to determine the correctness of the captured data. The receiver controller also includes a capturing frequency setting unit that sets a capturing frequency, which indicates the number of times the signal capturing action is performed during a certain period, in accordance with the correctness of the captured data.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF THE EMBODIMENTS

One embodiment of a radio wave receiver will now be described with reference to FIGS. 1 to 6.

Figure 1:
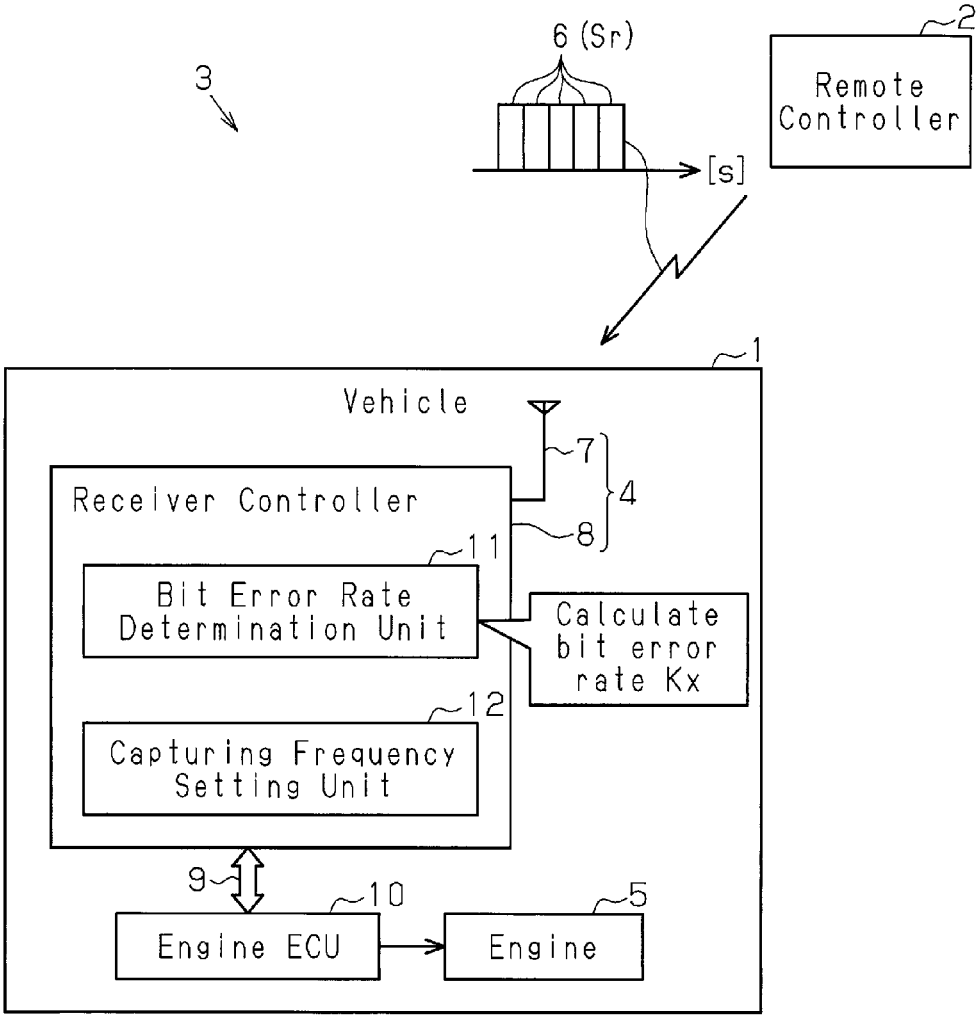
FIG. 1 is a schematic diagram illustrating a remote engine starter system in one embodiment.

Referring to FIG. 1, a vehicle 1 includes a remote engine starter system 3 that allows for a remote controller 2 to switch the operational condition (start/stop) of the engine 5 from a remote location. The remote engine starter system 3 includes a radio wave receiver 4 which is installed in the vehicle 1. The radio wave receiver 4 receives a remote operation signal Sr, which is transmitted on a radio wave from the remote controller 2, to start or stop the engine 5 based on the remote operation signal Sr. The remote controller 2 is one example of a remote terminal.

During a single radio wave transmission period, the remote controller 2 consecutively transmits a plurality of (five in the present example) frames 6, each functioning as a remote operation signal Sr. The frames 6 include the same data. For example, each frame 6 includes, from the head, a preamble, data, and, a tail bit. Further, each frame 6 has a bit length corresponding to a transmission time of, for example, 100 mS. Accordingly, in the present example that transmits five frames 6, a single radio wave transmission period would be 500 mS. The remote controller 2 transmits each frame 6 (remote operation signal Sr) on a radio wave in the ultrahigh frequency (UHF) band.

The radio wave receiver 4 includes an antenna 7, which is capable of receiving UHF radio waves (remote operation signals Sr), and a receiver controller 8, which controls the operation of the radio wave receiver 4. The radio wave receiver 4 is connected by an in-vehicle bus 9 to an engine ECU 10 which controls the operation of the engine 5. Based on the UHF radio wave (remote operation signal Sr) received by the antenna 7, the receiver controller 8 instructs the engine ECU 10 to switch the operational state of the engine 5.

Figure 2:
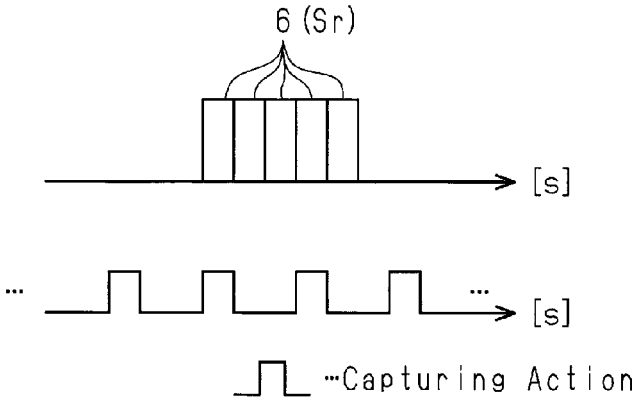
FIG. 2 is a time chart illustrating when a remote terminal transmits radio waves and when a radio wave receiver performs signal capturing actions.

Referring to FIG. 2, the receiver controller 8 intermittently performs a signal capturing action in regular or irregular intervals to capture frames from the radio wave transmitted from the remote controller 2. In other words, the receiver controller 8 captures a frame from a received radio wave when performing a signal capturing action. The number of times the receiver controller 8 performs the signal capturing action during a certain period is referred to as a capturing frequency. That is, the capturing frequency corresponds to the cycle in which the signal capturing action is repeated. In the present example, during a normal operation, the capturing frequency is set so that at least two of the five frames 6 transmitted during a single radio wave transmission period may be captured. The receiver controller 8 captures a single frame 6 in synchronization with a signal capturing action to obtain a remote operation signal Sr transmitted from the remote controller 2. When a frame 6 is not captured from its head, the frame 6 is discarded. The following frame 6 is captured from the head to obtain the remote operation signal Sr.

Referring to FIG. 1, the radio wave receiver 4 includes a function for adjusting the capturing frequency based on the error rate of the captured data. In the present example, the receiver controller 8 includes a bit error rate determination unit 11 that obtains a bit error rate Kx of the captured data. The captured data, that is, received data of a single frame 6, is configured by bits of "0" or "1". The bit error rate determination unit 11 calculates the error rate of the bits in the captured data to obtain the bit error rate Kx. The bit error rate Kx is an index indicating whether or not the captured data is close to the correct data (expected data). When the value of the bit error rate Kx is large, there is a high probability that data (radio wave) has not been correctly received. In other words, as the bit error rate Kx decreases and becomes closer to "0", the captured data becomes closer to the correct data. The bit error rate determination unit 11 is one example of a correctness determination unit.

Further, the receiver controller 8 includes a capturing frequency setting unit 12 that sets the capturing frequency in accordance with the bit error rate Kx. Even when the data is not correctly received and the captured data is not error-free, as long as the capturing frequency setting unit 12 determines from the bit error rate Kx that the captured data is close to the correct data, the capturing frequency setting unit 12 increases the capturing frequency. When determining from the bit error rate Kx that the captured data greatly deviates from the correct data, the capturing frequency setting unit 12 does not change the capturing frequency from a standard value.

The operation of the radio wave receiver 4 will now be described with reference to FIGS. 2 to 6.

[Standard Radio Wave Reception]

Figure 3:
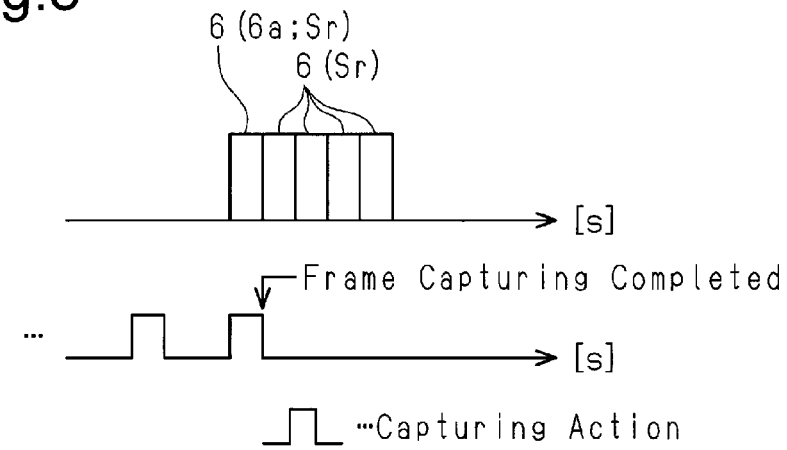
FIG. 3 is a time chart illustrating signal capturing actions performed at a standard capturing frequency.

Referring to FIG. 3, when the standard capturing frequency is set to a standard value, the radio wave receiver 4 intermittently performs the signal capturing action in a cycle allowing for two of the plurality of (five in the present example) frames 6 transmitted from the remote controller 2 to be captured during a single radio wave transmission period. For example, the interval between signal capturing actions is set to a time length that is slightly shorter than the total transmission time of two frames 6. In this manner, the setting of a low capturing frequency reduces the power consumption of the radio wave receiver 4. For example, when the remote controller 2 is operated to start the engine 5, the remote controller 2 transmits a remote operation signal Sr as an engine starting request signal in five consecutive frames 6 on a UHF radio wave.

In such a case, the radio wave receiver 4 captures a frame 6 when performing a signal capturing action and obtains the engine starting request signal from the remote controller 2. In the case illustrated in FIG. 3, the radio wave receiver 4 captures the first frame 6*a*. When the bits of the first frame 6*a* coincide with the expected values, the radio wave receiver 4 determines that the first frame 6*a* has been correctly received.

Each frame 6 includes an ID code and a command (in this case, engine starting command). The receiver controller 8 of the radio wave receiver 4 verifies the ID code in the frame 6*a*. When the ID code is verified, the radio wave receiver 4 sends an engine starting request to the engine ECU 10. In response to the engine starting request, the engine ECU 10 starts the engine 5.

[Operation for Increasing Capturing Frequency]

Figure 4:
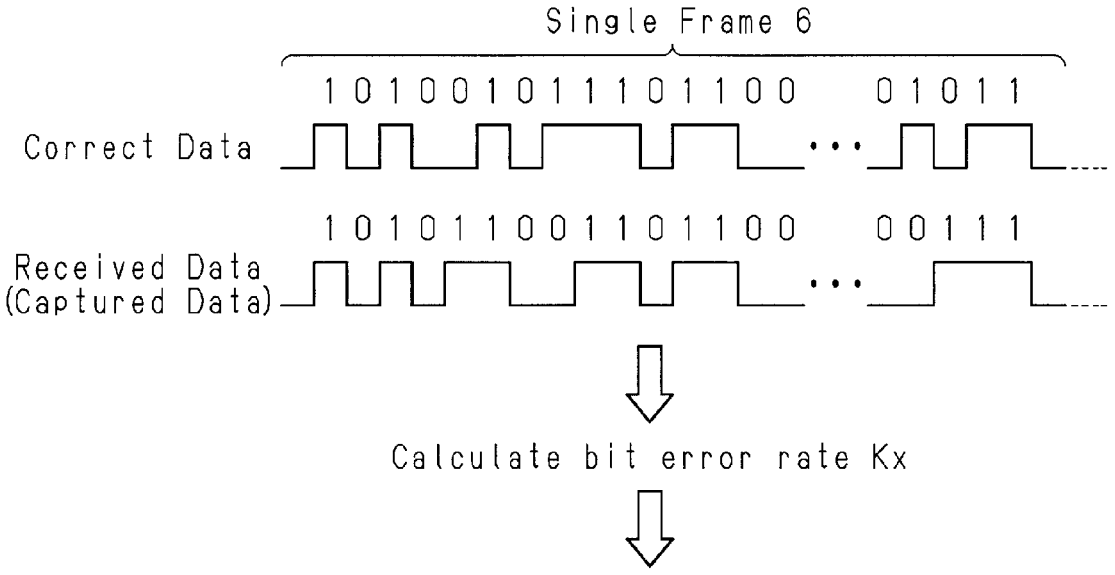
FIG. 4 is a diagram illustrating a process for adjusting the capturing frequency based on the bit error rate.

Referring to FIG. 4, when a frame 6 is captured, the bit error rate determination unit 11 checks the number of correct bits in the frame 6 to calculate the bit error rate Kx of the captured data. The bit error rate determination unit 11 provides the capturing frequency setting unit 12 with an instruction to increase the capturing frequency when any one of following conditions (a) to (c) is satisfied:

(a) in a captured frame, the bit error rate Kx is greater than zero and less than or equal to a reference value Ks;

(b) in consecutively captured frames, the bit error rate Kx is greater than zero and less than or equal to the reference value Ks; and (c) among a specified number of consecutively captured frames (e.g., ten frames received in the past), the bit error rate Kx is greater than zero and less than or equal to the reference value Ks in a predetermined number of frames.

When the bit error rate Kx is greater than zero and less than or equal to the reference value Ks, the bit error rate Kx has a low value, such as 5% or 10%. In this case, data (frame) has not correctly received and the captured data is not error-free but close to the correct data (expected data). In other words, although there may be a small number of bit errors caused by radio wave transmission errors or the like, the probability of correct data being captured would be high when the capturing frequency is increased. In contrast, when the bit error rate Kx is higher than the reference value Ks, it may be difficult to improve the receiving condition due to a poor radio wave condition such as noise or the like. Thus, in this case, the bit error rate determination unit 11 does not instruct the capturing frequency setting unit 12 to increase the capturing frequency.

Figure 5:
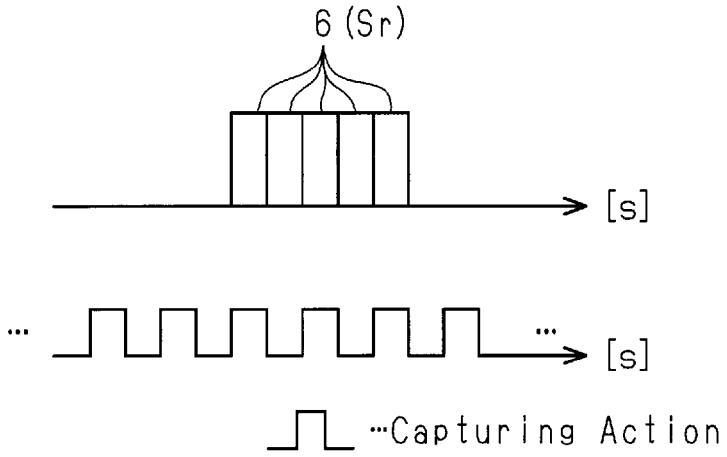
FIG. 5 is a time chart illustrating a process for increasing the capturing frequency.

The capturing frequency setting unit 12 increases the capturing frequency in accordance with the instruction from the capturing frequency setting unit 12 as illustrated in FIG. 5. For example, the capturing frequency setting unit 12 increases the capturing frequency to allow for three of the five frames 6 transmitted from the remote controller 2 during a single radio wave transmission period to be captured. This increases the probability of the radio wave receiver 4 capturing the frames 6 transmitted from the remote controller 2. Accordingly, the probability of the radio wave receiver 4 capturing the substantially correct data is increased. That is, the capturing success rate is increased.

[Operation for Decreasing Capturing Frequency]

Figure 6:
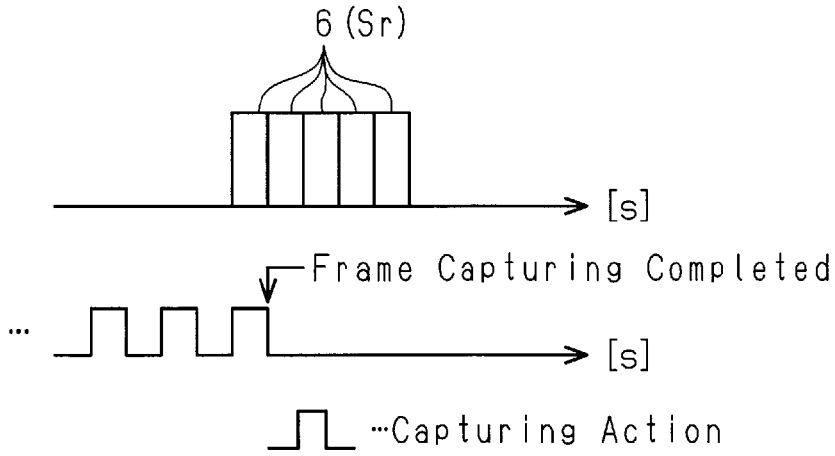
FIG. 6 is a time chart illustrating when the capturing of a frame is completed after the capturing frequency is increased.

Referring to FIG. 6, if the radio wave transmission environment improves after increasing the capturing frequency, the radio wave receiver 4 would be able to capture correct data (frame 6) when performing a signal capturing action. Even when the captured data is not correct data, the number of times a frame 6 of which the bit error rate Kx is greater than zero and less than or equal to the reference value Ks is captured would be increased.

After increasing the capturing frequency, the bit error rate determination unit 11 provides the capturing frequency setting unit 12 with an instruction to decrease the capturing frequency when any one of following conditions (d) and (e) is satisfied:

(d) a specified number of consecutively captured frames 6 are correct data (expected data); and (e) among a specified number of consecutively captured frames, the bit error rate Kx is greater than zero and less than or equal to the reference value in a predetermined number of frames or less.

The capturing frequency setting unit 12 decreases the capturing frequency in accordance with an instruction from the bit error rate determination unit 11 as illustrated in FIG. 2. For example, the capturing frequency setting unit 12 decreases the capturing frequency to allow for two of the five frames 6 transmitted from the remote controller 2 during a single radio wave transmission period to be captured. That is, the capturing frequency setting unit 12 returns the capturing frequency to the standard value. This reduces the power consumption of the radio wave receiver 4.

The present embodiment has the following advantages.

(1) During a standard operation, the radio wave receiver 4 sets the capturing frequency to the minimum value (e.g., twice) to capture data (frames 6). This minimizes the number of times the signal capturing action is performed and reduces power consumption. The receiver controller 8 calculates the bit error rate Kx of the captured data and increases the capturing frequency when the bit error rate Kx is greater than zero and less than or equal to the reference value Ks. That is, the receiver controller 8 increases the capturing frequency when the bit error rate Kx is in a range in which the capturing of correct data may be expected. In this manner, the capturing frequency is optimized. This improves the data capturing success rate of the radio wave receiver 4 while reducing power consumption.

(2) The remote controller 2 transmits a plurality of frames 6 during a single radio wave transmission period. This increases the probability of one of the frames 6 transmitted from the remote controller 2 being captured by the radio wave receiver 4. Accordingly, the data capturing success rate may be improved.

(3) The bit error rate determination unit 11 uses the bit error rate Kx of each frame 6 to determine the deviation of the captured data from the correct data (expected data). In this manner, the deviation of the captured data may be determined through a simple process that checks the correctness of each bit in the frame 6.

(4) The capturing frequency setting unit 12 increases the capturing frequency when the bit error rate Kx is greater than zero and less than or equal to the reference value Ks. In this configuration, the capturing frequency is increased only when in a satisfactory radio wave transmission environment. This reduces power consumption.

(5) The radio wave receiver 4 does not increase the capturing frequency when the bit error rate Kx is greater than the reference value Ks, that is, when the bit error range Kx is in a range in which correct data may not be expected. Since the reception frequency is not increased in an unnecessary manner, the power consumption of the radio wave receiver 4 may be further reduced.

(6) The conditions for increasing the capturing frequency include the bit error rate Kx being greater than zero and less than or equal to the reference value Ks in consecutively captured frames. The conditions for increasing the capturing frequency further include among a specified number of consecutively captured frames (e.g., ten frames received in the past), the bit error rate Kx being greater than zero and less than or equal to the reference value Ks in a predetermined number of frames. In this manner, the bit error rate determination unit 11 monitors the bit error rate Kx, and the capturing frequency setting unit 12 adjusts the capturing frequency based on the monitoring result. This optimizes the capturing frequency.

(7) When the receiving condition improves after increasing the capturing frequency, the capturing frequency setting unit 12 returns the capturing frequency to the standard value. Since the situation in which the capturing frequency is increased does not continue in an unnecessary manner, the power consumption of the radio wave receiver 4 may be further reduced.

It should be apparent to those skilled in the art that the present invention may be embodied in many other specific forms without departing from the spirit or scope of the invention. Particularly, it should be understood that the present invention may be embodied in the following forms.

The cycle of the signal capturing action, that is, the capturing frequency may be changed in accordance with, for example, the length of the standby time during which the radio wave is not received. For example, when a situation in which the radio wave is not received continues for a long time, the cycle of the signal capturing action may be prolonged. This further reduces the power consumption of the radio wave receiver 4.

When decreasing the capturing frequency after increasing the capturing frequency, the capturing frequency does not have to be returned to the standard value. For example, by omitting a signal capturing action, the interval between two signal capturing actions may be prolonged, and the capturing frequency may be decreased.

The number of times the signal capturing action is repeated during a single radio wave transmission period is not limited to an integer and may be a value including a decimal point such as 2.5.

The frequency of the radio wave may be changed to another frequency such as a low frequency (LF).

The number of frames transmitted from the remote controller 2 during a single radio wave transmission period may be one.

When the standard value of the reception frequency is set to, for example, two times, the capturing frequency may be changed to less than two times when determined that the communication environment is satisfactory. In this configuration, under a situation in which the communication environment is satisfactory, unnecessary signal capturing actions are not performed. This reduces power consumption.

For example, when the standard value of the capturing frequency is set to two times or three times, the capturing frequency may be decreased to less than the standard value when the communication environment is satisfactory and returned to the standard value when the communication environment deteriorates.

The index used to determine the deviation of the captured data (received data) from the correct data (expected data) is not limited to the bit error rate and may be, for example, a bit correctness rate.

Figure 7:
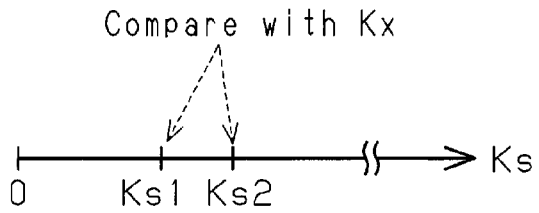
FIGS. 7 and 8 are diagrams illustrating the setting of reference values.

Referring to FIG. 7, a plurality of reference values Ks may be used, such as Ks1 and Ks2.

Figure 8:
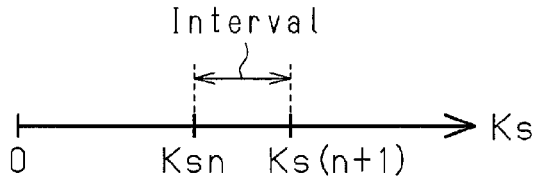

Referring to FIG. 8, when using a plurality of reference values Ks, the interval between the reference values Ks1 and Ks2 to Ksn and Ks(n+1) may be set to any value.

The capturing frequency for each of the reference values Ksn and Ks(n+1) may be set to any value.

When using a plurality of reference values Ks, for example, reference values Ks1, Ks2, and Ks3 ($Ks1<Ks2<Ks3$), the bit error rate Kx under a situation in which correct data cannot be received may be classified in the four stages of $0<Kx\leq Ks1$, $Ks1<Kx\leq Ks2$, $Ks2<Kx\leq Ks3$, and $Ks3<Kx$. In this case, the capturing frequency does not have to be adjusted by monotonously increasing the capturing frequency as the bit error rate Kx increases. For example, the capturing frequency is set to be higher in the order of when $0<Kx\leq Ks1$ is satisfied, when $Ks1<Kx\leq Ks2$ is satisfied, and when $Ks2<Kx\leq Ks3$ is satisfied. If $Ks3<Kx$ is satisfied, the capturing frequency may be set to be lower than when $Ks2<Kx\leq Ks3$ is satisfied. This also applies when using two reference values Ks.

The capturing frequency may be increased in accordance with the bit error rate Kx. More specifically, the capturing frequency may be increased by a smaller value if the bit error rate Kx is low, and the capturing frequency may be increased by a larger value if the bit error rate Kx is high. In this case, the capturing frequency does not have to be monotonously increased in accordance with the bit error rate Kx. For example, the capturing frequency may be changed and become maximal at a certain point like a quadratic function.

Figure 9:
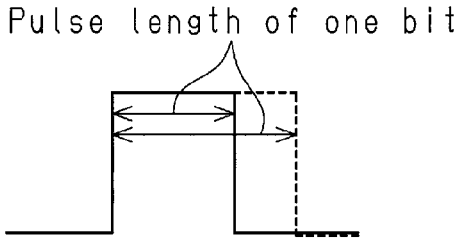
FIG. 9 is a waveform chart illustrating one example of a process for determining the bit correctness.

Referring to FIG. 9, the deviation of the captured data (received data) from the correct data (expected data) may be determined from the correctness of the pulse width for each bit. In this manner, a variety of processes may be applied to determine the deviation of the expected data and the captured data.

The radio wave receiver 4 of the above embodiment does not have to be applied to the engine starter system 3. For example, ID verification may be performed through narrow range communication when communication is established with an electronic key (wireless key), and the radio wave receiver 4 may be applied to a wireless key system that controls an on-vehicle device (e.g., vehicle door lock) based on the verification result.

The range in which the capturing of correct data may be expected and the range in which the capturing of correct data may not be expected are variable. That is, the reference value Ks is variable.

The remote terminal is not limited to the remote controller 2 and may be any of a variety of instruments and devices.

The radio wave receiver 4 of the above embodiment does not have to be a system applied to the vehicle 1 and may be applied to another device, instrument, or system.

The receiver controller 8 of the radio wave receiver 4 in the above embodiment may be realized by a dedicated hardware circuit or program instructions (software) executed by a computer processor such as a CPU. When using software, a computer processor may execute program instructions stored in a non-transitory computer-readable storage medium (e.g., memory such as a RAM) to realize the radio wave receiver 4. In this case, for example, the program instructions include instructions configured to cause the computer processor to perform a signal capturing action in regular or irregular intervals to capture data transmitted on a radio wave from a remote controller (remote terminal) when the signal capturing action is performed. Further, the program instructions include instructions configured to cause the computer processor to calculate an error rate or a correctness rate of the captured data. The program instructions also include instructions configured to cause the computer processor to set a capturing frequency indicating the number of times the signal capturing action is performed during a certain period (e.g., single radio wave transmission period) in accordance with the error rate or the correctness rate.

The present examples and embodiments are to be considered as illustrative and not restrictive, and the invention is not to be limited to the details given herein, but may be modified within the scope and equivalence of the appended claims.

The invention claimed is:

1. A radio wave receiver comprising a receiver controller that performs a signal capturing action in regular or irregular intervals to capture data transmitted on a radio wave from a remote terminal in synchronization with the signal capturing action, wherein the receiver controller includes:

a correctness determination unit configured to calculate an error rate or a correctness rate of the data captured by the receiver controller to determine the correctness of the captured data, and a capturing frequency setting unit configured to set a capturing frequency, which indicates the number of times the signal capturing action is performed during a certain period, in accordance with the correctness of the captured data, wherein the receiver controller is configured to capture data of a single frame by the signal capturing action, the correctness determination unit is configured to calculate a bit error rate of the data of the single frame, and the capturing frequency setting unit is configured to increase the capturing frequency when any one of following conditions (a) to (c) is satisfied, (a) in a captured frame, the bit error rate is greater than zero and less than or equal to a reference value;

(b) in consecutively captured frames, the bit error rate is greater than zero and less than or equal to the reference value; and (c) among a specified number of consecutively captured frames, the bit error rate is greater than zero and less than or equal to the reference number in a predetermined number of frames;

wherein the capturing frequency setting unit is configured to decrease the capturing frequency after increasing the capturing frequency when any one of following conditions (d) and (e) is satisfied, (d) a specified number of consecutively captured frames are correct data; and (e) among a specified number of consecutively captured frames, the bit error rate is greater than zero and less than or equal to the reference value in a predetermined number of frames or less.

2. The radio wave receiver according to claim 1, wherein the capturing frequency setting unit is configured to repeat the signal capturing action during a single radio wave transmission period in which a plurality of frames are transmitted from the remote terminal.

3. The radio wave receiver according to claim 1, wherein the receiver controller is configured to capture data of the single frame by the signal capturing action, the single frame is configured by bits of "0" or "1", and the correctness determination unit is configured to calculate the error rate or the correctness rate by checking the number of bits correctly captured in the data of the single frame.

4. The radio wave receiver according to claim 1, wherein the capturing frequency setting unit is configured to increase the capturing frequency when the error rate or the correctness rate is in a range allowing for reception of correct data to be expected.

5. The radio wave receiver according to claim 1, wherein the capturing frequency setting unit is configured to maintain the capturing frequency when the error rate or the correctness rate is in a range in which reception of correct data may not be expected.

6. The radio wave receiver according to claim 1, wherein the correctness determination unit is configured to monitor the error rate or the correctness rate, and the capturing frequency setting unit is configured to increase the capturing frequency when a situation in which the error rate or the correctness rate is in a range allowing for reception of correct data to be expected occurs a predetermined number of times.

7. The radio wave receiver according to claim 1, wherein the capturing frequency setting unit is configured to decrease the capturing frequency when determining that a receiving condition has improved after increasing the capturing frequency.

8. The radio wave receiver according to claim 1, wherein the receiver controller is configured to capture data of the single frame by the signal capturing action, the correctness determination unit is configured to calculate the bit error rate of the data of the single frame, and the capturing frequency setting unit is configured to increase the capturing frequency by a first predetermined value when the bit error rate is greater than zero and less than or equal to a first reference value, and increase the capturing frequency by a second predetermined value when the bit error rate is greater than the first reference value and less than or equal to a second reference value, wherein the second predetermined value is greater than the first predetermined value.

9. The radio wave receiver according to claim 8, wherein the capturing frequency setting unit is configured to decrease the capturing frequency when the bit error rate of a frame captured after increasing the capturing frequency by the second predetermined value is greater than the second reference value.

10. A communication system comprising:

a remote terminal capable of transmitting radio waves;

an antenna capable of receiving the radio waves transmitted from the remote terminal; and the receiver controller according to claim 1 connected to the antenna.

11. A radio wave receiver comprising a receiver controller that performs a signal capturing action in regular or irregular intervals to capture data transmitted on a radio wave from a remote terminal in synchronization with the signal capturing action, wherein the receiver controller includes:

a correctness determination unit configured to calculate an error rate or a correctness rate of the data captured by the receiver controller to determine the correctness of the captured data, and a capturing frequency setting unit configured to set a capturing frequency, which indicates the number of times the signal capturing action is performed during a certain period, in accordance with the correctness of the captured data, wherein the receiver controller is configured to capture data of a single frame by the signal capturing action, the correctness determination unit is configured to calculate a bit error rate of the data of the single frame, and the capturing frequency setting unit is configured to increase the capturing frequency by a first predetermined value when the bit error rate is greater than zero and less than or equal to a first reference value, and increase the capturing frequency by a second predetermined value when the bit error rate is greater than the first reference value and less than or equal to a second reference value, wherein the second predetermined value is greater than the first predetermined value;

wherein the capturing frequency setting unit is configured to decrease the capturing frequency when the bit error rate of a frame captured after increasing the capturing frequency by the second predetermined value is greater than the second reference value.

* * * * *